United States Patent [19]

Alley

[11] 4,096,413

[45] Jun. 20, 1978

[54] FLICKER ELIMINATING INTENSITY CONTROLLER FOR DISCHARGE LAMP DIMMING CIRCUIT

[75] Inventor: Robert P. Alley, Manlius, N.Y.

[73] Assignee: General Electric Company, Carmel, Ind.

[21] Appl. No.: 659,665

[22] Filed: Feb. 20, 1976

[51] Int. Cl.[2] ..... H05B 41/392

[52] U.S. Cl. ..... 315/276; 315/194; 315/244; 315/291; 315/DIG. 4

[58] Field of Search ..... 315/239, 276, 244, 194, 315/199, 291, 307, DIG. 4

[56] References Cited

U.S. PATENT DOCUMENTS

| | | | |
|---|---|---|---|
| 3,767,940 | 10/1973 | Herzog | 315/252 F |
| 3,878,431 | 4/1975 | Petrina | 315/199 X |
| 3,935,502 | 1/1976 | Herzog | 315/DIG. 4 |

*Primary Examiner*—Eugene R. LaRoche

[57] ABSTRACT

To solve a flicker problem in a discharge lamp dimming system which results from non-synchronous high frequency, substantially sinusoidal perturbation signals imposed upon the AC line, the intensity control section of the circuit is modified. In one form of the preferred embodiment, a secondary winding of the input transformer is spaced apart from the primary winding thereof to increase the leakage reactance of the secondary winding and to decrease the capacitive coupling between windings. A capacitance of suitable value is connected across the output of the secondary winding thereby allowing the combination to serve as a low pass filter to block the line perturbation signals. In another form of the preferred embodiment, a differentiator-limiter-integrator network is included in circuit to provide a non-perturbed zero-crossing for the firing circuit, ie, the intensity controller, thereby to eliminate flicker.

8 Claims, 11 Drawing Figures

FLICKER ELIMINATING INTENSITY CONTROLLER FOR DISCHARGE LAMP DIMMING CIRCUIT

BACKGROUND OF THE INVENTION

I. Field of the Invention

The present invention relates to an improved firing circuit capable of reducing the effects of non-synchronous, high frequency line perturbations on its output, and more particularly, to such a firing circuit for use as an intensity selector for a gaseous discharge lamp dimming system.

II. Description of the Prior Art

Dimming systems for gaseous discharge lamps, and in particular, fluorescent lamps, generally utilize an auxiliary circuit in the form of a power switch which is controlled by an intensity selector. The power switch, usually a thyristor, supplies current to the lamp or lamps and secures various illumination or dimming levels by controlling the interval of current conduction through the lamps during each half cycle of the power supply. The intensity selector which controls the thryistor is made selectively variable to provide continuous adjustment of level of illumination. One such dimming system is disclosed in U.S. Pat. No. 3,863,102 — Herzog, assigned to the General Electric Company and another is disclosed in U.S. Pat. No. 3,767,940 — Herzog et al, also assigned to the General Electric Company.

A major problem occurring in such dimming systems for fluorescent lamps has been, and is, flicker. Flicker is a phenonenon which results from an instability or variability, regularly or irregularly, of light level and may be quite annoying to the viewer. Flicker may occur at both high and low light levels as well as at any intermediate light level.

This flicker problem is addressed in the aforementioned U.S. Pat. No. 3,863,102 patent wherein at least one source of such flicker was recognized and solved, that being in the auxiliary circuit. Another source of flicker was addressed and essentially obviated in U.S. Pat. No. 3,935,502 — Herzog, also assigned to the General Electic Company. Therein flicker was found to be caused by the ballast wherein non-symmetrical half cycles of lamp current occurred, this because one end of the lamp was grounded through a heater winding while the other side was allowed essentially to float.

For years, however, flicker has persisted in certain installations. Through much experimentation and study, it was found that where a fluorescent lamp dimming system is used at a location where a supply line of high impedence feeds both the dimming system and a relatively large induction motor such as found in a heat pump, air conditioner or compressor, and both lines are concurrently in use, a non-synchronous, high frequency, substantially sinusoidal signal is imposed upon the AC line. This high frequency ripple produces varying AC power line zero-crossing times which result, in turn, in unequal "on" times for the lamps; the eye interprets this as flicker. If this zero-crossing time varies 50 microseconds (out of 8330 microseconds for 60 Hz), the results are objectionable.

It is desirable, therefore, to provide a dimming system for gaseous discharge lamps, and in particular, fluorescent lamps, wherein the visual effects of non-synchronous, high-frequency AC line perturbations are minimized.

Accordingly, it is an object of the present invention to provide a firing circuit capable of use as an intensity controller for such a dimming system wherein means are provided for eliminating the visual effects of such AC line perturbations.

SUMMARY OF THE INVENTION

In accordance with the present invention, there is provided a firing circuit of the type having an input transformer including a primary winding for connecting the circuit to a line source of AC electrical energy wherein means are provided for eliminating the visual effects of non-synchronous, high frequency AC line perturbations. In one form of the preferred embodiment, a secondary winding in the transformer is spaced apart from the primary winding thereof for increasing leakage reactance of the secondary winding and for decreasing capacitve coupling between the windings, and a capacitance having a value suitable for allowing the combination to serve as a low pass filter is connected across the output of the secondary winding. In another aspect of the invention, there is provided an intensity control circuit for a gaseous discharge lamp dimming system. Also included is a transformer having a primary winding for connection to a line source of AC electrical energy and a seconary winding having output means including a pair of end leads and a center tap and rectifier means for producing a pulsating DC potential. A voltage regulating means is connected to the output means of the secondary winding for producing a regulated DC potential across the regulating means and a charging means is connected across the regulating means. A programmable unijuncton transistor (PUT) includes an anode terminal, a cathode terminal and a gate terminal, the anode terminal being connected to the charging means for providing anode voltage for the PUT. A voltage divider is connected across the output means of the secondary winding and includes means for providing a selectively variable gate voltage for the PUT. At least one solid-state switch is provided having a control terminal connected to the PUT cathode terminal for turning on the switch upon conduction of the PUT. Means are also provided for eliminating the visual effects of non-synchronous, high-frequency line perturbations.

DESCRIPTION OF THE PREFERRED EMBODIMENT

Figure 1:
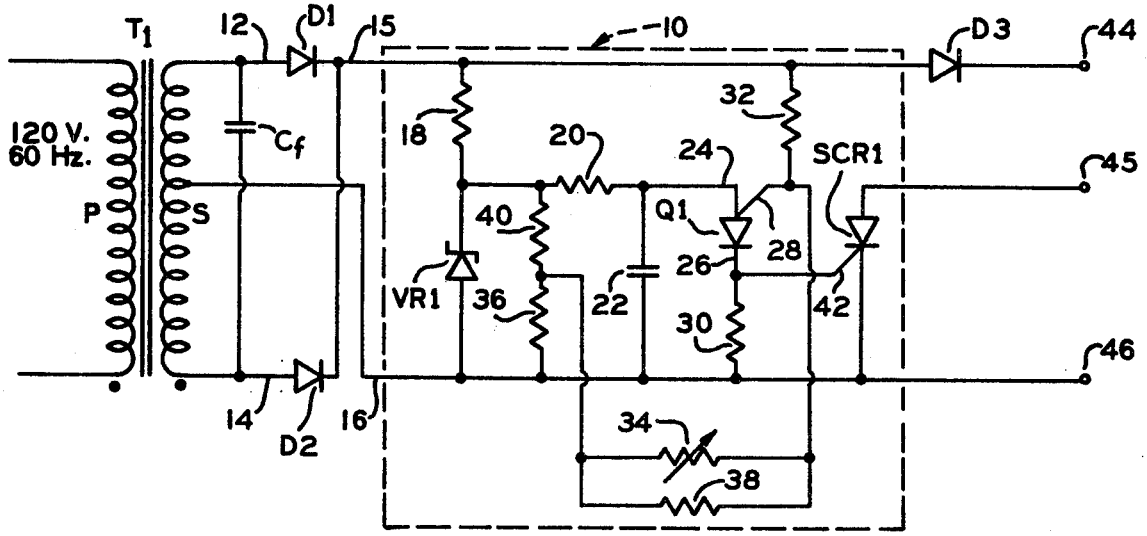
FIG. 1 is a schematic representation of the preferred embodiment of the firing circuit of the present invention, in one form thereof.

Referring now to FIG. 1, there is shown a timing circuit 10 (enclosed by dotted lines) useful as a firing circuit type of intensity controller for a gaseous discharge lamp dimming system of the type shown in U.S. Pat. No. 3,863,102 — Herzog, issued Jan. 28, 1975, and U.S. Pat. No. 3,767,940 — Herzog et al, issued October 23, 1973, both of which are specifically incorporated herein by reference. The firing circuit includes at least one solid-state switch in the form of a controlled rectifier SCR1 and associated firing circuitry. Also included is an input transformer T1 including a primary winding P for connecting the circuit to a line source of AC electrical energy such as, for example, 120 volts 60 Hz. Input transformer T1 also includes a secondary winding S having output means including a pair of end leads 12 and 14 and a center tap 16. Rectifier means including a pair of diodes D1 and D2 are connected to end leads 12 and 14 respectively, the cathodes of diodes D1 and D2 being electrically connected together for producing a pulsating DC potential between common point 15 thereof and center tap 16; lines 15 and 16 therefore become power leads. Voltage regulating means in the form of a zener diode VR1 is connected serially with a resistor 18 across leads 15 and 16 of the output means. Charging means including a resistor 20 and a capacitor 22 are connected across zener diode VR1 between its connection with resistor 18 and power lead 16. A programmable unijunction transistor (PUT) Q1 includes an anode terminal 24, a cathode terminal 26 and a gate terminal 28 and is connected in circuit such that anode 24 is connected to the junction of resistor 20 and capacitor 22 which form the charging circuit. Cathode 26 of PUT Q1 is connected through a resistor 30 to power lead 16. A voltage divider consisting of a series connection of resistor 32, variable resistor 34 and resistor 36 is connected across power leads 15 and 16. Another resistor 38 is connected in parallel with variable resistor 34. The junction of variable resistor 34 and resistor 32 is connected to the gate terminal of PUT Q1.

In operation, a pulsating DC voltage appears across power leads 15 and 16. The voltage regulating device, zener diode VR1 provides a regulated voltage less than the maximum voltage across leads 15 and 16. This regulated voltage is impressed on the charging circuit to build a charge on the capacitor 22. This voltage is in effect the anode voltage of PUT Q1. The voltage divider circuit extending from lead 15 to lead 16 provides a voltage which is a percentage of the instantaneous supply voltage as determined by the relative size of the resistances to the gate 28 of PUT Q1. When the voltage on capacitor 22 exceeds the voltage on gate 28, the PUT will conduct and current will flow from its cathode 26 through resistance 30 to lead 16. The gate 42 of the control rectifier SCR1 is connected to the cathode 26 of PUT Q1. When the PUT conducts, a signal is fed to the gate 42 of SCR1 thereby causing it to fire. Output leads 44, 45 and 46 may then be connected in a circuit with a dimming system as shown in the aforementioned Herzog — U.S. Pat. No. 3,863,102 patent.

In accordance with the present invention, there is provided means for reducing the effects of non-synchronous, high frequency line perturbations. In the form of the preferred embodiment shown in FIG. 1, this includes secondary winding S of transformer T1 arranged to be spaced apart from the primary winding P thereof for increasing leakage reactance of the secondary winding S and for decreasing capacitive coupling between the windings of the transformer. Also included is a capacitance in the form of a capacitor $C_f$ connected across end leads 12 and 14 of the secondary winding S, capacitor $C_f$ being of a suitable value to allow the combination to serve as a low pass filter. It has been found that when a transformer is constructed as shown in FIG. 2, this capacitor $C_f$ advantageously has a value of between 0.8 and 1.8 microfarads.

Figure 2:
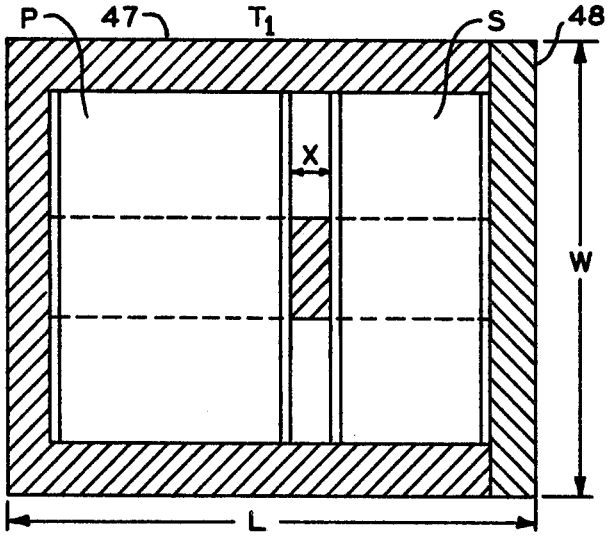
FIG. 2 is a plan view of an input transformer constructed for the firing circuit in accordance with the teachings of the present invention.

Referring now to FIG. 2, it can be seen that transformer T1 includes a laminated core constructed to an "I" shaped end piece 48 welded to an "E" shaped section 47 and having overall dimensions:

L = 2 in.

W = 1⅝ in

Figure 3:
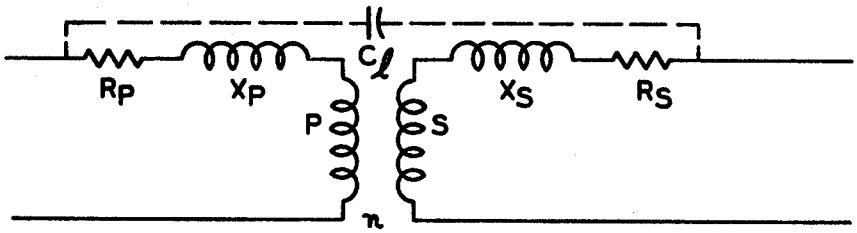
FIG. 3 shows by schematic representation the equivalent circuit of a tranformer built as shown in FIG. 2.
Figure 4:
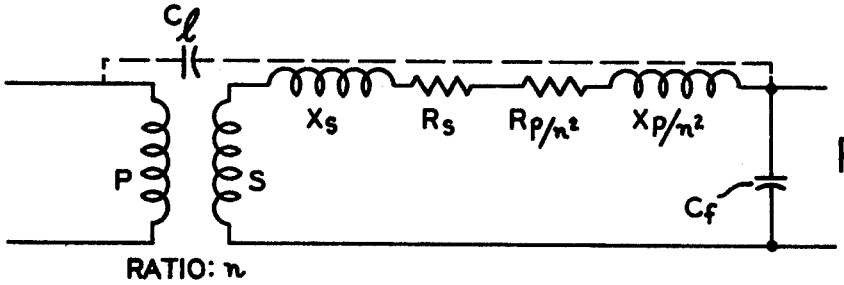
FIG. 4 shows the result of moving the circuit components from the primary of FIG. 3 to the secondary thereof.
Figure 5:
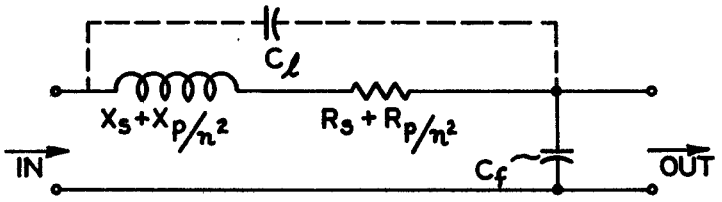
FIG. 5 shows the simplified equivalent output circuit of FIG. 4.

The windings are bobbin mounted and are of the pancake type. Primary winding P (120 V 60 Hz) has 1690 turns of 0.0063 inch dia. wire and secondary winding S has 840 turns of 0.0063 inch dia. wire. The separation X between the windings found satisfactory is approximately 3/32 in. This separation of the primary winding and the secondary winding increases the leakage reactance of the secondary winding S and decreases the capacitive coupling between the windings. The equivalent circuit is shown in FIG. 3 wherein $C_1$ is the leakage capacitance. This equivalent circuit is the same as the textbook classic except that the X's have been maximized for the size and the capacitance $C_1$ is quite low. By placing a capacitor $C_f$ on the output and transferring equivalent circuit components to the seconary winding S for clarity, we have the circuit shown in FIG. 4. Because the two windings are somewhat remote on the core, there is not too much mutual inductance which, in closely coupled transformers, keeps the impedance, as seen from the output or input, low. The output circuit then becomes that shown in FIG. 5. This is a simple low pass filter and since $C_1$ is much much less than $C_f$, the shunting impedance around this equivalent circuit is very high.

Figure 6:
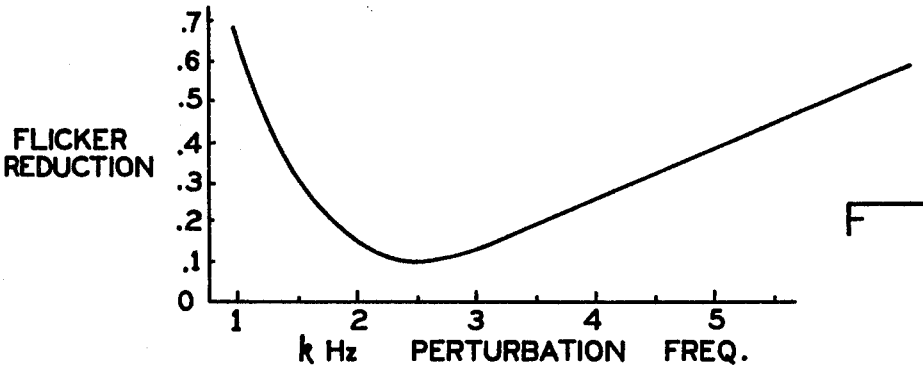
FIG. 6 plots the quotients of the percentage of light fluctuation in the present circuit over the typical prior art circuit against perturbation frequency.

Plotting the ratio of light fluctuations with and without this filter we have the graph of FIG. 6. On the vertical axis there is plotted a quotient (flicker reduction) of the percentage calculated by taking a measurement of the maximum and the minimum light output and computed max − min/max for the improved circuit over a like percentage calculated for the typical prior art arrangement, this plotted against line perturbation frequency on the horizontal axis. As can be seen, the most improvement appears between 2 and 3 k Hz perturbation frequency. It should be noted that the capacitance $C_f$ can not be increased without limit as this serves to produce a phase shift between the control and the lamp ballast which can cause another type of flashing disturbance as the control point jumps into the preceding or following half cycle. For these measurements, capacitance $C_f$ was chosen to have a value of one microfarad.

Figure 7:
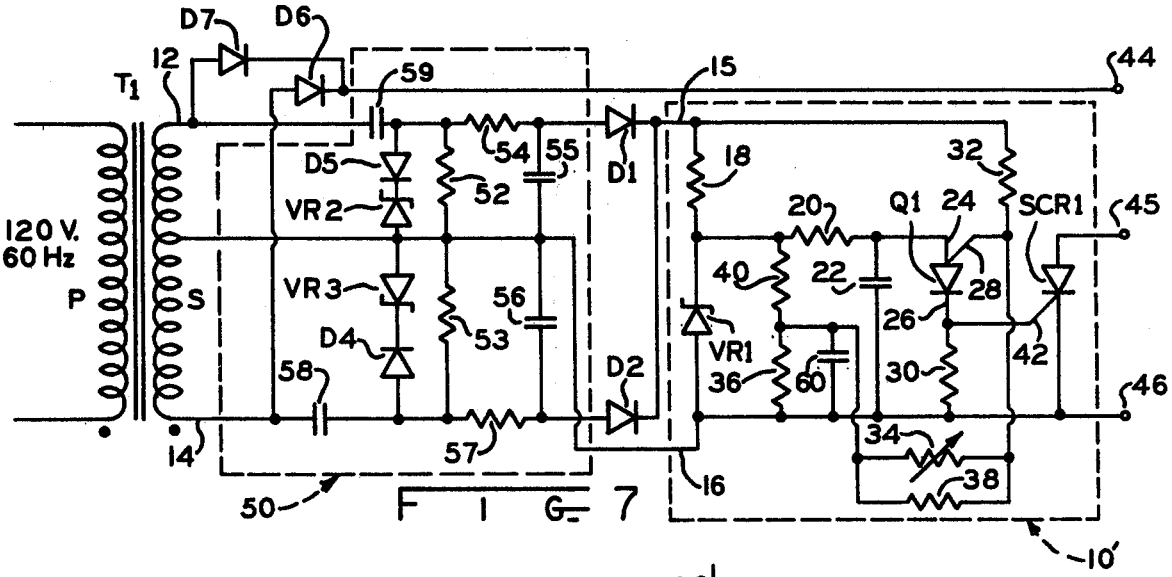
FIG. 7 is a schematic representation of another form of the preferred embodiment.

Referring now to FIG. 7, there is shown another form of the preferred embodiment of the present invention. Components of the circuit 10' of FIG. 7 which correspond to that of FIG. 1 are numbered and lettered accordingly. For reducing the effects of non-synchronous high frequency AC line perturbations, there is included a differentiator-limiter-integrator network enclosed in dotted lines and denoted generally as 50. Network 50 serves to supply a non-perturbed zero-crossing for the firing circuit. Intensity selectors for fluorescent lamp dimming of the type shown in FIG. 1 owe part of their successful performance to the production of quite identical light pulses each half cycle. Part of this process is involved in resetting the charge on the timing capacitor 22 to a consistently small value at the zero voltage of each half cycle. This resetting-timing process is perturbed cyclically if the zero crossing of the voltage wave is shifted by non-harmonic high frequency superimposed on the power line and the result is a variation in light output each half cycle; this the eye interprets as flicker. Because the primary effect on the intensity selector is due to this zero crossing shift, if the wave form could be "laundered" only for this interval, performance improvement would result. Such an improvement can be accomplished by using the differentiator-limiter-integrator network 50 as shown in FIG. 7. As will now be described mathematically and pictorially, this differentiator-limiter-integrator is capable of removing the high frequency perturbations at the voltage zero-crossing where they cause the greatest problems. If a power line input voltage is represented as:

$$e = \sin wt + K \sin 2\pi ft$$

then $e = \sin 377t + K \sin 2\pi ft$ where 377 represents $2\pi 60 = w$ $f$ is a non-integral multiple of 60 and K is the peak voltage proportion of the high frequency. This is the actual occurrence as found in a small proportion of fluorescent dimming installations. The input wave for $f = 3605$ Hz perturbation (FIG. 8):

$$e = \sin 377\,t + 0.01 \sin 22650\,t$$

where a 1% high frequency component is causing problems. Differentiating the waveform:

$$de/dt = +377 \cos 377\,t + (0.01)(22650) \cos 22650\,t$$

therefore $$de/dt = 377 \cos 377\,t + 227 \cos 22650\,t$$

Figure 9:
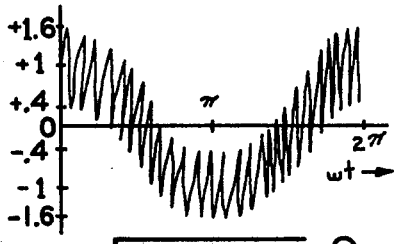

Normalizing for fundamental $$de/dt = \cos 377\,t + 0.6 \cos 22650\,t \text{ (see FIG. 9)}$$

Note that the high frequency component has grown from 1% of the fundamental to 60% of the fundamental. By limiting or clipping to an arbitrary value of 0.4 of the waveform, we have a wave form which has no high frequency present at $t = o, \pi$, etc. This can be represented by $$o \leqq \left|\frac{de}{df} = \cos 377\,t + .6 \cos 22650\,t\right| \leqq .4 \qquad \text{(See FIG. 10)}$$

This means that there is no high frequency component when we integrate this wave form, after limiting, for those periods of time corresponding to $t = o, \pi$, etc., which represent the zero-crossing points of the original wave and again become the zero-crossing points for the new wave form. Integrating and normalizing we then get:

$$\begin{cases} t = o + e, \pi + e, \ldots n\pi + e \\ \dfrac{de}{dt} = \cos 377\,t\,dt \\ t = o - e, \pi - e, \ldots n\pi - e \end{cases} \qquad \text{(FIG. 11)}$$

where $e$ is a very small period of time which can be adjusted by the level of limiting to any value; if it is negative, there will be some high frequency still existing at the zero-crossings.

Since the wave form is full wave rectified in the control, the phase reversal incidental to the process is of no consequence.

These operations on the line wave form may be done at the control power level (as was done here) or may also be done at a very low signal level and then an amplifier could resurrect the desired wave form for use by the control.

The circuit disclosed in FIG. 7 was built and can be understood in reference to the previous equations and referenced figures. It should be understood that the waveforms may be obtained either from leads 12 to 14 or from lead 12 to 14 to center tap 16. Since the circuit is symmetrical about point 16, the primary discussion will be centered upon this type of a waveform.

Figure 8:
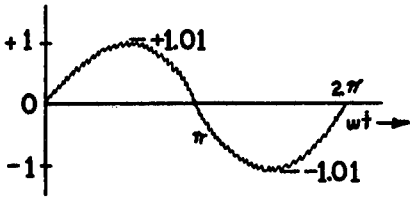
FIGS. 8 - 11 depict, graphically the step by step effects of the differentiator-limiter-integrator network 50 upon non-synchronous, high frequency line perturbations.
Figure 10:
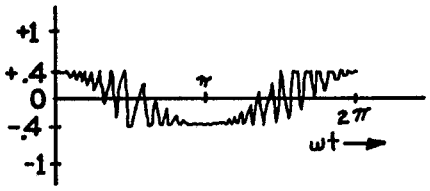
Figure 11:
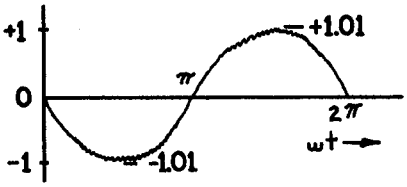

The waveform shown in FIG. 8 will be observed between leads 12 and 14. If the components D5 and VR2 (VR3, D4) were removed, the waveform shown in FIG. 9 would be that observed across resistor 52 (53). By the inclusion of the diode D5 and zener diode VR2 (D4, VR3) the signal appearing across resistor 52 (53) is that which is shown in FIG. 10. The components are chosen such that at the minimum desired input voltage, clipping action will remove all traces of the high frequency component at the time intervals of 0 and $\pi$The waveform is then integrated from that shown in FIG. 10 by the components: resistor 54 and capacitor 55 (57, 56). The integrated voltage which appears across capacitor 55 (56) is that which is shown in FIG. 11. This "laundered" waveform is that which is applied to the timing circuitry of the control to remove the effects of the voltage zero crossing perturbation present in the original waveform. Diodes D1 and D2 rectify the waveform in FIG. 11 such that the polarity reversal is of no consequence.

An intensity control circuit as shown in FIG. 1 has been built and has operated satisfactorily with components having the following values and/or model numbers:

| | |
|---|---|
| Transformer T1 | |
| Primary P | 1690 turns (120 v, 60 Hz) .0063" dia wire |
| Secondary S | 840 turns (total) .0063" dia wire |
| Capacitor $C_f$ | 1.0 uf |
| Capacitor 22 | 0.047 uf |
| Diodes D1, D2, D3 | IN 4004 |
| PUT Q1 | GE D13T1 |
| SCR 1 | 2N4184 |
| Zener Diode VR1 | 10V |
| Resistors 18, 30 | 1 K ohm |
| Resistor 20 | 100 K ohm |
| Ressitor 32 | 15 K ohm |
| Resistor 34 | 0 - 10 K ohm - vrbl |
| Resistor 36 | 680 ohms |
| Resistor 38 | Chosen during assembly, usually about 22,000 Ω |
| Resistor 40 | 4.7 K ohm |

The circuit of FIG. 7 also has been built and has operated satisfactorily with additional components having the following values and/or model numbers:

| | |
|---|---|
| Diodes D4, D5, D6, D7 | IN 4004 |
| Zener Diodes VR2, VR3 | 39 V |
| Resistors 52, 53 | 47 K ohms |
| Resistors 54, 57 | 2.2 K ohms |
| Capacitors 55, 56 | 1.0 uf |
| Capacitors 58, 59 | 10.2 uf |
| Capacitor 60 | 0.01 uf |

While an embodiment and application of this invention has been shown and described, it will be apparent to those skilled in the art that modifications are possible without departing from the inventive concepts herein described. The invention, therefore, is not to be restricted except as is necessary by the prior art and the spirit of the appended claims.

What is claimed is:

1. In a firing circuit for use as an intensity controller for a fluorescent lamp dimming system, the firing circuit being of the type having an input transformer including a primary winding for connecting the circuit to a line source of AC electrical energy and further including a secondary winding, the improvement comprising:

means for eliminating the visual effects of non-synchronous, high frequency AC line perturbations.

2. The circuit of claim 1 wherein the means for eliminating includes: the secondary winding on the transformer spaced apart from the primary winding thereof whereby leakage reactance of the secondary winding is increased and capacitive coupling between the windings is decreased; and a capacitance connected across the output of the secondary winding, the capacitance being of a suitable value to allow the combination to serve as a low pass filter.

3. The circuit of claim 2 wherein the capacitance has a value of between 0.8 and 1.8 microfarad.

4. The circuit of claim 1 wherein the means for eliminating includes:

a differentiator-limiter-integrator network connected across the output of the secondary winding for producing an output voltage having a non-perturbed zero-crossing.

5. An intensity control circuit for a gaseous discharge lamp dimming system, comprising:

a transformer including a primary winding for connection to a line source of AC electrical energy, and a secondary winding having output means including a pair of end leads and a center tap and rectifier means for producing a pulsating DC potential;

voltage regulating means connected to the output means of the secondary winding for producing a regulated DC potential across the regulating means;

charging means connected across the regulating means;

a programmable unijunction transistor having an anode terminal, a cathode terminal and a gate terminal, the anode terminal being connected to the charging means for providing anode voltage for the transistor;

a voltage divider connected across the output means of the secondary winding and including means for providing a selectively variable gate voltage for the transistor;

at least one solid-state switch having a control terminal connected to the transistor cathode terminal for turning on the switch upon conduction of the transistor; and means for eliminating the visual effects of non-synchronous, high frequency line perturbations.

6. The circuit of claim 5 wherein the means for eliminating includes:

the secondary winding on the transformer being arranged in a spaced apart relationship with respect to the primary winding thereof whereby leakage reactance of the secondary winding is increased and capacitive coupling between the windings is decreased; and a capacitance connected across the end leads of the secondary winding; the capacitance being of a value suitable for allowing the combination to act as a low pass filter.

7. The circuit of claim 6 wherein the capacitance has a value of between 0.8 and 1.8 microfarads.

8. The circuit of claim 5 wherein: the means for eliminating includes a differentiator-limiter-integrator network connected to the end leads and center tap of the secondary winding thereby to yield an output voltage having a non-perturbed zero-crossing.

* * * * *

UNITED STATES PATENT AND TRADEMARK OFFICE

CERTIFICATE OF CORRECTION

PATENT NO. : 4,096,413
DATED : June 20, 1978
INVENTOR(S) : Robert P. Alley

It is certified that error appears in the above-identified patent and that said Letters Patent are hereby corrected as shown below:

Column 4, line 51, "max-min/max" should read
--(max-min)/max--;

Column 5, line 43, "cos 22650" should read
--cos 22650t--;

Column 5, line 44, "t" should be deleted;

Column 5, line 60, "$\frac{de}{df}$" should read
--$\frac{de}{dt}$--

Column 6, line 38, after "$\pi$" insert --.--

Signed and Sealed this
*Sixteenth* Day of *January 1979*

[SEAL]

*Attest:*

RUTH C. MASON
*Attesting Officer*

DONALD W. BANNER
*Commissioner of Patents and Trademarks*